US006463125B1

(12) United States Patent
Minas et al.

(10) Patent No.: US 6,463,125 B1
(45) Date of Patent: Oct. 8, 2002

(54) HIGH PERFORMANCE X-RAY TARGET

(75) Inventors: Constantinos Minas, Slingerlands; Mark G. Benz, Burnt Hills; Charles G. Mukira; Paul A. Siemers, both of Clifton Park; Thomas Robert Raber, Schenectady, all of NY (US); John Robert Breunissen, Wauwatosa, WI (US); Richard Warren Lindberg, Williams Bay, WI (US); Gregory A. Steinlage, Milwaukee, WI (US); Douglas J. Snyder, Brookfield, WI (US); Ping Huang, Milwaukee, WI (US); James Michael Gent, Whitefish Bay, WI (US); Gregory Reznikov, Akron, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/541,847

(22) Filed: Apr. 3, 2000

Related U.S. Application Data

(60) Provisional application No. 60/136,433, filed on May 28, 1999.

(51) Int. Cl.[7] ..... H01J 35/10

(52) U.S. Cl. ..... 378/144; 378/143; 378/127

(58) Field of Search ..... 378/144, 143, 378/127, 128, 129

(56) References Cited

U.S. PATENT DOCUMENTS

| | | | | | |
|---|---|---|---|---|---|
| 3,751,702 | A | * | 8/1973 | Dietz | 378/125 |
| 4,132,917 | A | | 1/1979 | Bildstein et al. | 378/144 |
| 4,276,493 | A | | 6/1981 | Srinivasa et al. | |
| 4,520,496 | A | * | 5/1985 | Schreiber et al. | 378/128 |
| 4,736,400 | A | | 4/1988 | Koller et al. | |
| 4,847,883 | A | * | 7/1989 | Fourre | 378/144 |
| 4,944,448 | A | | 7/1990 | Peschmann et al. | |
| 4,978,051 | A | | 12/1990 | Tiearney, Jr. et al. | |
| 5,414,748 | A | * | 5/1995 | Upadhya | 378/144 |
| 5,825,848 | A | | 10/1998 | Virshup et al. | |
| 6,002,745 | A | * | 12/1999 | Miller et al. | 378/128 |
| 6,088,426 | A | | 7/2000 | Miller | |
| 6,125,169 | A | | 9/2000 | Wandke et al. | |

* cited by examiner

*Primary Examiner*—Drew A. Dunn
(74) *Attorney, Agent, or Firm*—Armstrong Teasdale LLP

(57) ABSTRACT

A brazed X-ray target includes a metallic cap and a graphite back including a nonlinear record groove attached thereto along a stepped surface. An upper corner joint of the stepped surface is distanced from a cap outer edge and a focal track where the maximum heat is generated during use of the target. The graphite back is extended outward toward the cap outer edge to increase a thermal storage of the graphite, and a recess is formed into the cap to maintain a selected moment of inertia of the target and thereby maintain the rotordynamics of a given X-ray tube.

20 Claims, 3 Drawing Sheets

HIGH PERFORMANCE X-RAY TARGET

CROSS REFERENCE TO RELATED APPLICATIONS

This application claims the benefit of U.S. provisional application No. 60/136,433 filed May 28, 1999.

BACKGROUND OF THE INVENTION

This invention relates generally to X-ray tube anode targets, and more specifically to brazed X-ray tube anode targets.

X-ray beam generating devices, or X-ray tubes, typically comprise dual electrodes of an electrical circuit within an evacuated chamber or tube. The electrical circuit generates a beam of electrons directed toward an anode target. A surface of the anode target converts the kinetic energy of the electron beam against the target to high frequency electromagnetic waves, i.e., X-rays, which are collimated and focused for penetration through an object for internal examination purposes.

The high velocity electron beam impinging on the target surface, or focal track, generates extremely high and localized temperatures in the target structure accompanied by high internal stresses leading to deterioration and breakdown of the target. Consequently, a rotating anode target is typically used to minimize localized heat concentration and stresses. By rotating the target, a focal track region impinged by the electron beam is continually changed and the heat effects are better distributed throughout the structure. See, for example, U.S. Pat. No. 5,414,748.

One type of known rotating anode target includes a refractory metal cap having a focal track for producing X-rays when bombarded by the electrons from a cathode according to known techniques. A graphite back is attached to the cap by known brazing methods to provide a heat sink for the heat which is transferred from the metal cap and from the focal track. See, for example, U.S. Pat. No. 5,178,136. However, during extended operation of an X-ray tube, separation of the brazed graphite back from the metal cap has been observed as an end of life failure mode.

Accordingly, it would be desirable to provide a longer life X-ray target that avoids the failure mode of separation of the graphite back and cap.

BRIEF SUMMARY OF THE INVENTION

In an exemplary embodiment of the invention, a rotatable X-ray target includes a circular cap having an outer edge and a stepped surface adjacent the outer edge. A focal track is formed on a first surface of the cap adjacent the outer edge. A step extends radially inward from the outer edge and a graphite back is brazed to the step. A corner of the step is moved radially inward from the cap outer edge, thereby distancing the corner from the focal track where the maximum heat is generated and reducing a heat load on the corner. The graphite back extends radially outward beyond the step, thereby reducing the thermal stress in the graphite and increasing a thermal storage of the graphite.

A recess is formed into the cap first surface between the focal track and a rotational axis to maintain a selected moment of inertia of the target and thereby maintain the rotor dynamics of a given X-ray tube. Consequently, the brazed step joint encounters less heat and reduces the strain on the braze material, thereby reducing instances of separation of the brazed graphite back.

DETAILED DESCRIPTION OF THE INVENTION

Figure 1:
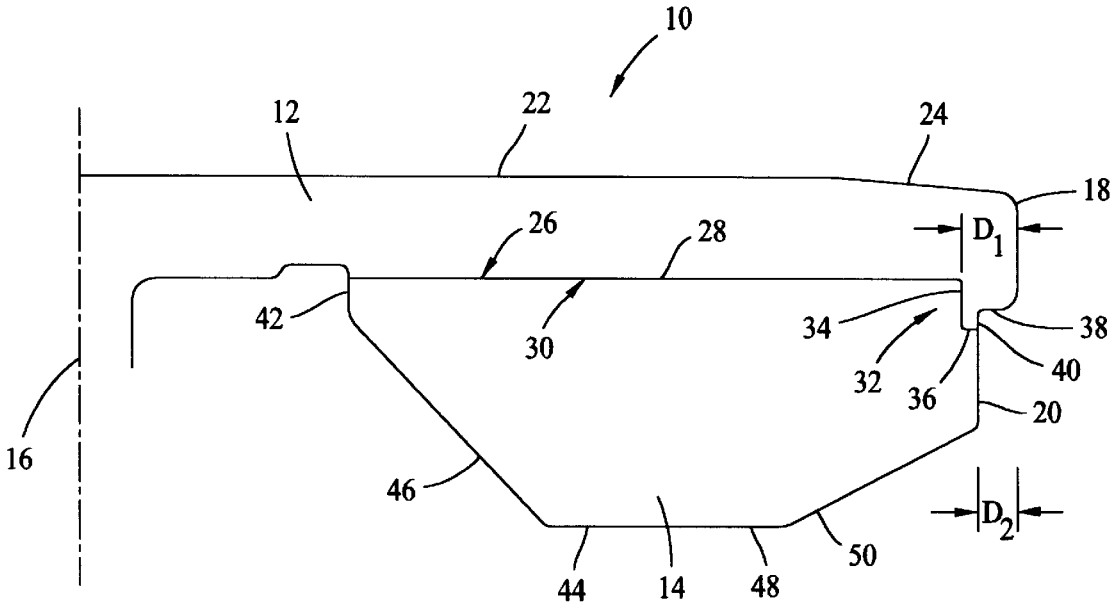
PRIOR ART FIG. 1
FIG. 1 is a partial cross sectional view of a known X-ray anode target.

FIG. 1 is a partial cross sectional view of one half of a known X-ray target 10 including a metallic cap 12 and a back 14 fabricated from graphite. Cap 12 and back 14 are generally symmetrical about a rotational axis 16 and include substantially circular outer edges 18, 20, respectively, extending radially outwardly from rotational axis 16.

Metallic cap 12 is fabricated from refractory metals such as tungsten and molybdenum or one of their many alloys. In a particular embodiment, metallic cap 12 is fabricated from TZM metal, an alloy including titanium, zirconium, and molybdenum which has been found effective in resisting distortion during the thermal cycles generated by electron beam bombardment. Cap 12 includes a substantially flat top surface 22 extending from rotational axis 16 to a focal track 24 formed thereon by powder metallurgy techniques. In a particular embodiment, focal track is formed from a tungsten-rhenium alloy. Focal track 24 is substantially flat and extends from cap top surface 22 at a negative slope toward cap outer edge 18.

Cap bottom surface 26 includes a substantially flat portion 28 parallel to cap top surface 22 and adjacent a substantially flat top surface 30 of graphite back 14. A step 32 extends from cap bottom surface 26 and is positioned radially inward a distance $D_1$ from cap outer edge 18. Step 32 includes a vertical portion 34 extending substantially perpendicular to cap bottom surface flat portion 28, and a horizontal portion 36 extending a length substantially parallel to cap bottom surface flat portion 28 toward graphite back outer edge 20, which is located an inward radial distance $D_2$ from cap outer edge 18. A shoulder 38 extends radially inward from cap outer edge 18 between cap bottom surface 26 and step horizontal portion 36 to a cap inner edge 40 extending substantially parallel to step vertical portion 34. Thus, cap inner edge 40 and graphite back outer edge 20 form a substantially continuous surface.

Graphite back top surface 30 is generally complementary in shape to cap bottom surface 26 and step 32, and graphite back 14 is attached to cap bottom surface 26 and step 32 using known metal brazing techniques. Graphite back 14 includes an inner edge 42 extending substantially perpendicular to cap bottom surface 26 and a bottom surface 44 including an inner sloped portion 46, a center portion 48, and an outer sloped portion 50. Center portion 48 extends substantially parallel to cap bottom surface 26. Inner sloped portion 46 extends from inner edge 42 to center portion 48 and has a negative slope. Outer sloped portion 50 extends from center portion 48 to outer edge 20. Graphite back 14 is shaped and dimensioned adequately to store and dissipate heat generated when focal track 24 is bombarded with electrons from an X-ray cathode (not shown).

While X-ray target 10 is effective in producing X-rays, it has been observed that cap 12 tends to separate, or de-bond from, graphite back 14 during extended use of an associated X-ray tube. Cap 12, graphite back 14, and focal track 24 each have a different coefficient of thermal expansion due to differences in the respective fabrication materials.

Consequently, thermal stresses and strains result in the components of X-ray target 10. Maximum stresses and strains have been found at an upper corner of the brazed joint between cap 12 and graphite back 14 where step vertical portion 34 intersects cap bottom surface flat portion 28. Observation has confirmed that de-bonding of the brazed joint begins at the upper corner.

Figure 2:
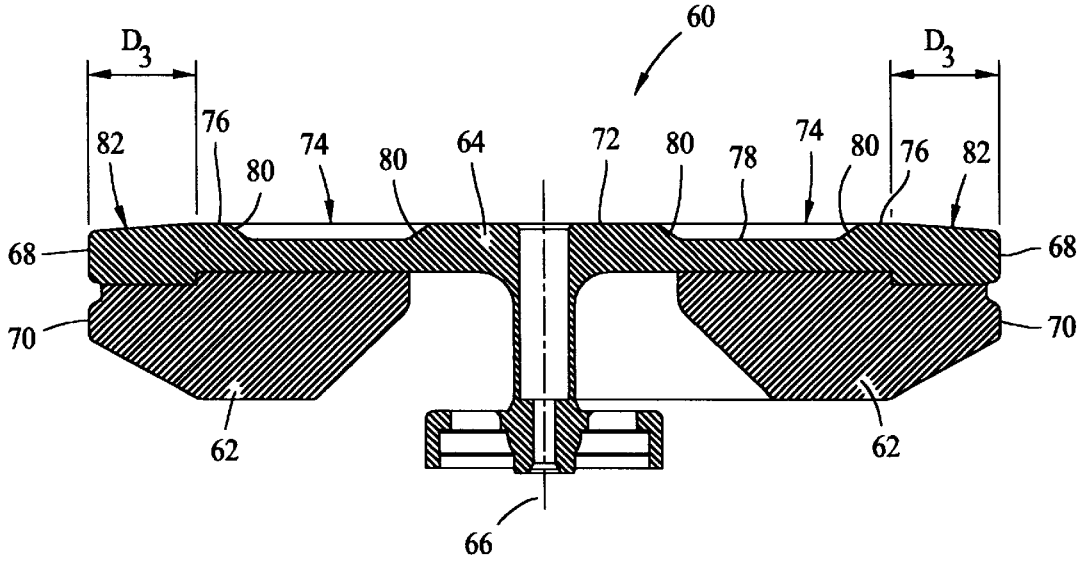
FIG. 2 is a cross sectional view of an X-ray anode target in accordance with one embodiment of the present invention.

FIG. 2 is a cross sectional view of an X-ray target 60 that decreases premature de-bonding of a brazed graphite back 62 from a metallic cap 64 fabricated from, for example, TZM Molybdenum alloy. Cap 64 and back 62 are generally symmetrical about a rotational axis 66 and include substantially circular outer edges 68, 70, respectively, extending radially outwardly from rotational axis 66. Cap 64 includes a substantially circular and flat center top surface 72 extending from rotational axis 66, an annular top surface recess 74 extending radially outwardly from flat center top surface 72, and a substantially flat and annular outer top surface 76 extending from top surface recess 74. Top surface recess 74 includes a substantially flat bottom surface 78 extending substantially parallel to flat center top surface 72 and outer top surface 76, and contoured sides 80. A focal track 82 is formed by powder metallurgy techniques between flat outer top surface 76 and cap outer edge 68. Focal track 82 is substantially flat and extends a distance $D_3$ from outer top surface 76 to cap outer edge 68 at a negative slope. In an exemplary embodiment, focal track 82 is formed from a tungsten-rhenium alloy.

Figure 3:
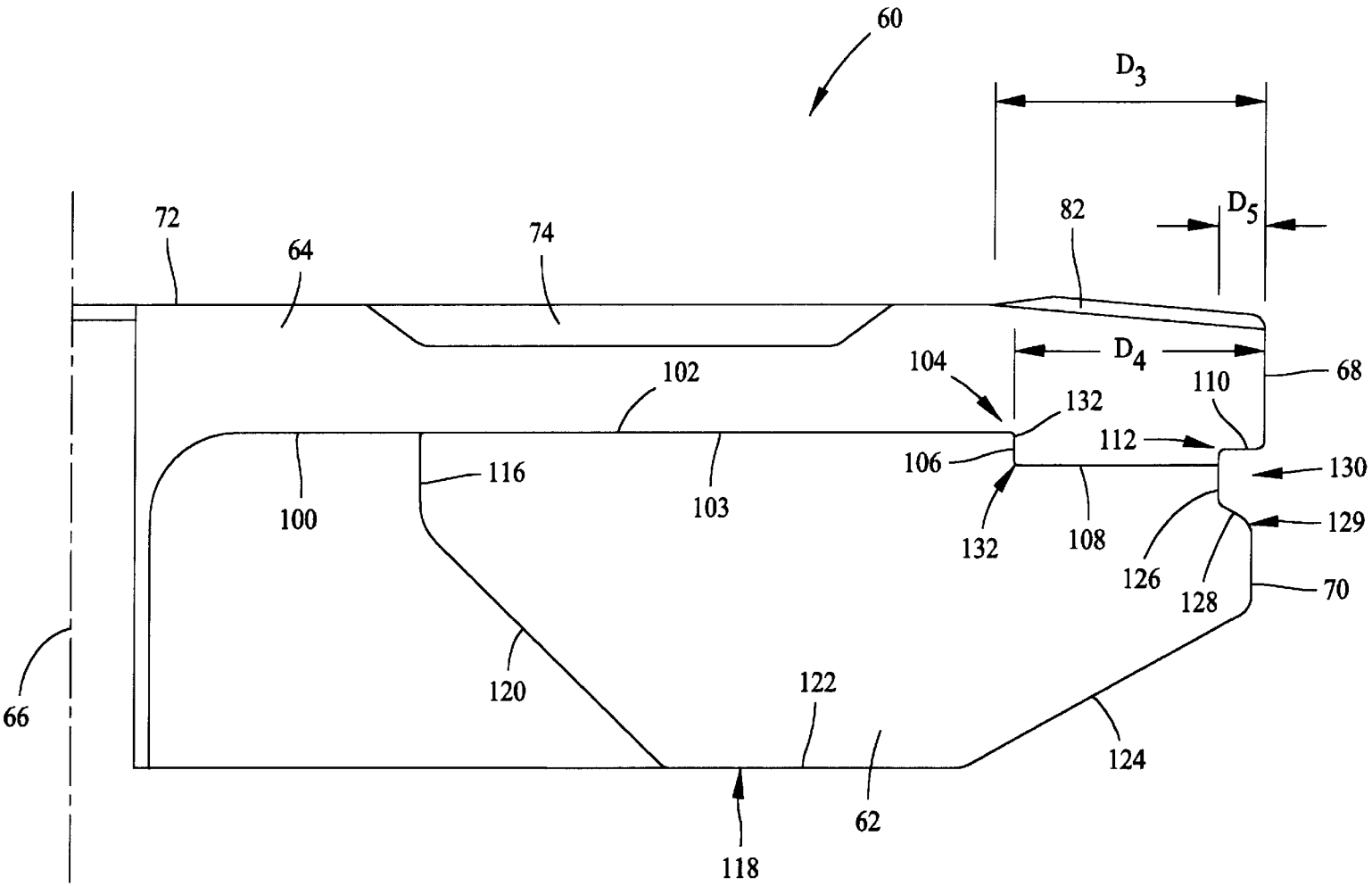
FIG. 3 is a magnified view of a portion of the X-ray anode target shown in FIG. 2.

FIG. 3 is a magnified view of a portion of X-ray target 60 shown in FIG. 2. A cap bottom surface 100 includes a substantially flat portion 102 parallel to cap center top surface 72 and adjacent a substantially flat top surface 103 of graphite back 62. A step 104 extends from cap bottom surface 100 and is positioned radially inward a distance $D_4$ from cap outer edge 68 that is approximately equal to distance $D_3$ that focal track 82 extends from cap outer edge 68. Step 104 includes a vertical portion 106 extending substantially perpendicular to cap bottom surface flat portion 102, and a horizontal portion 108 extending a length substantially parallel to cap bottom surface flat portion 102. A shoulder 110 extends radially inward from cap outer edge 68 between cap bottom surface 100 and step horizontal portion 108 and substantially parallel to cap bottom surface 100. A radius 112 extends between step horizontal portion 108 and shoulder 110.

Graphite back top surface 103 is generally complementary in shape to cap bottom surface 100 and step 104, and graphite back 62 is attached to cap bottom surface 100 and step 104 using known metal brazing techniques. Graphite back 62 includes an inner edge 116 extending substantially perpendicular to cap bottom surface 100 and a bottom surface 118 including an inner sloped portion 120, a center portion 122, and an outer sloped portion 124. Center portion 122 extends substantially parallel to cap bottom surface 100. Inner sloped portion 120 extends from inner edge 116 to center portion 122 and has a negative slope. Outer sloped portion 124 extends from center portion 122 to outer edge 70.

A graphite back intermediate edge 126 is located a radial distance $D_5$ from cap outer edge 68 and extends substantially perpendicular to horizontal step portion 108. A contoured connector portion 128 extends between intermediate edge 126 and graphite back outer edge 70 forming an outside step 129 on graphite back 62. Graphite back intermediate edge 126, connector portion 128, cap radius 112, and shoulder 110 form a groove or notch 130 between cap outer edge 68 and graphite back outer edge 70, which both extend approximately the same radial distance from rotational axis 66.

The structure of X-ray target 60 generates the following advantages in comparison to known X-ray target 10 (shown in FIG. 1). An upper corner of the brazed joint (not shown) between graphite back 62 and metallic cap 64, i.e., where step vertical portion 106 meets cap bottom surface 100, is moved radially inward because of the increased length of step horizontal portion 108 in comparison to X-ray target 10. Consequently, the upper corner of the brazed joint is moved further away from focal track 82 where the most intense heat is generated during use of X-ray target 60. Further, graphite back outer edge 70 is extended radially outward in comparison to X-ray target 10 (shown in FIG. 1), thereby increasing the volume of graphite material, reducing the thermal stress, and increasing the heat storage capacity of back 62. Also, radiused corners 132 of step 104 (shown in FIG. 3) relieve stress concentrations in component materials of cap 64 and back 62. The culmination of these improvements is a cooler brazed joint during use of X-ray target 60, and an increased capacity for extended use beyond the capability of known X-ray target 10.

Top surface recess 74 is dimensioned to balance the extension of graphite back outer edge 70 and the increased volume of metal in step 104 relative to X-ray target 10, and also to maintain a pre-selected polar and transverse moment of inertia of X-ray target 60 while changing the plastic strain characteristics of cap 10 over periods of extended use. Thus, X-ray target 60 may be used in existing X-ray tubes with strategic positioning and dimensioning of top surface recess 74 to match the rotordynamics of an existing X-ray target 10. Thus, recalibration or modification of an X-ray tube is unnecessary.

Figure 4:
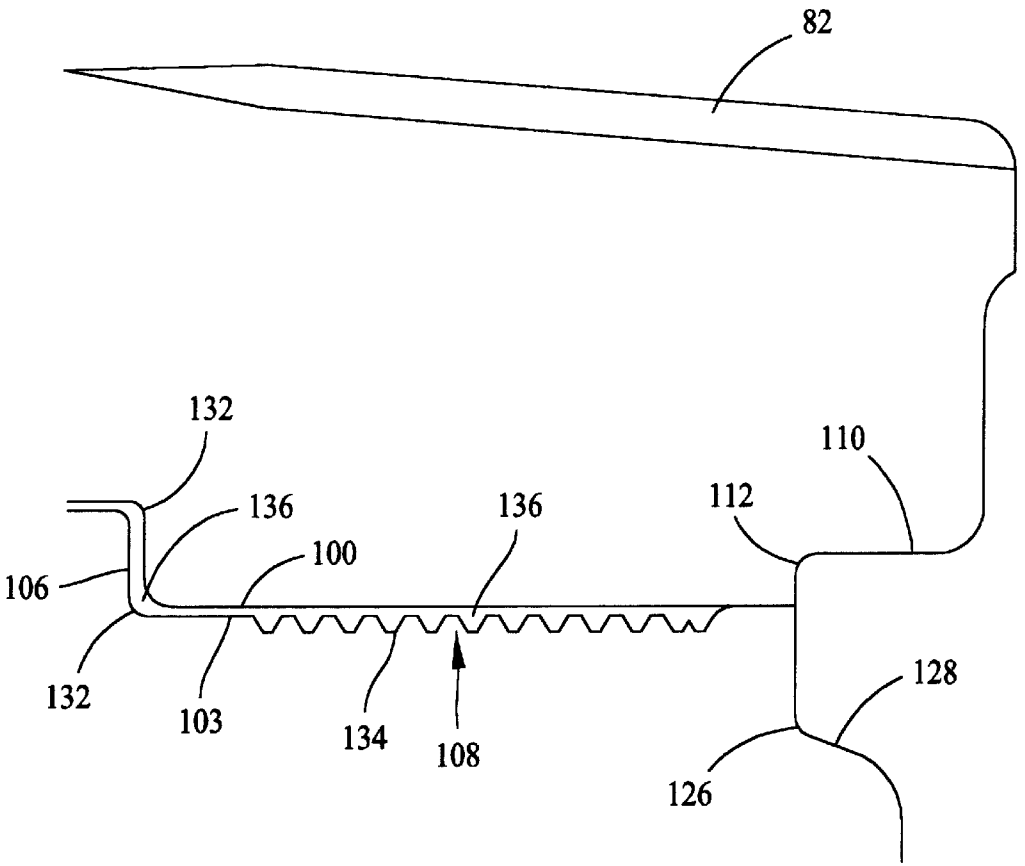
FIG. 4 is a magnified view of a portion of the X-ray anode target shown in FIG. 3.

FIG. 4 is a magnified view of step horizontal portion 108 including a record groove 134 machined in back top surface 100 that forms a nonlinear boundary between brazed metal 136 and graphite back 132. Brazed metal 136 joins cap bottom surface 100 and back top surface 100. Record groove increases a surface area of contact between brazed metal 136 and back top surface 100 and hence forms a stronger bond. Record groove 134 is sinusoidal in shape, and it is believed that record groove 136 prevents propagation of cracks in brazed metal 136 across the amplitudes of record groove 136. In an exemplary embodiment, record groove 134 includes a depth of 0.4 mm, a spacing of 0.9 mm, and an included angle of 30°.

While the invention has been described in terms of various specific embodiments, those skilled in the art will recognize that the invention can be practiced with modification within the spirit and scope of the claims.

What is claimed is:

1. A method for preventing separation of a TZM molybdenum alloy cap from a graphite back of a circular X-ray target, the graphite back attached to the cap by metal brazing along a step joint including a corner, the cap including an outer edge and a focal track, said method comprising:

positioning a step radially inward from the cap outer edge a distance that is approximately equal to a distance that the focal track extends from the cap outer edge, thereby reducing a heat load on the corner; and extending the graphite radially outward, thereby increasing a thermal storage of the graphite and reducing a thermal stress.

2. A method in accordance with claim 1 wherein the cap includes a top surface, said method further comprising the step of forming a recess in the top surface, thereby maintaining a selected moment of inertia of the target.

3. A method in accordance with claim 1 wherein the method further comprises the step of rounding the corners of the step joint.

4. A method in accordance with claim 1 wherein the step extends a length, said method further comprising the step of increasing the length of the step.

5. An method in accordance with claim 1 further comprising the step of machining a record groove into the graphite back prior to brazing the cap to the back, the record groove forming a nonlinear boundary.

6. An X-ray target comprising:

a circular cap comprising an outer edge, a focal track, and a step adjacent said outer edge, said step extending radially inward from said outer edge a distance that is approximately equal to a distance that said focal track extends from said cap outer edge; and a back brazed to said step and extending radially beyond said step.

7. An X-ray target in accordance with claim 6 wherein said cap further comprises a first surface opposite said stepped surface, said first surface comprising a portion configured to maintain a selected moment of inertia.

8. An X-ray target in accordance with claim 7 wherein said cap further comprises a focal track on said first surface and extending radially inward from said outer edge.

9. An X-ray target in accordance with claim 8 wherein said focal track comprises a tungsten-rhenium alloy.

10. An X-ray target in accordance with claim 8 wherein said focal track extends a first radial distance from said outer edge, said step extending a second radial distance from said outer edge, said first and second distances approximately equal.

11. An X-ray target in accordance with claim 6 wherein said step comprises a rounded corner.

12. An X-ray target in accordance with claim 6 wherein said cap comprises a TZM molybdenum alloy.

13. An X-ray target in accordance with claim 6 wherein said back comprises graphite.

14. An X-ray target in accordance with claim 6 wherein said back comprises a record groove comprising a nonlinear boundary.

15. An X-ray target comprising:

a rotational axis;

a TZM molybdenum cap comprising a first surface, a second surface, and an outer edge, said second surface comprising a step adjacent said outer edge, said cap generally symmetrical about said rotational axis;

a tungsten-rhenium alloy focal track formed on said first surface adjacent said edge;

a graphite back comprising a top surface and a nonlinear record groove formed on said top surface; said graphite back brazed to said step along said record groove; and a recess formed into said first surface between said focal track and said rotational axis.

16. An X-ray target in accordance with claim 15 wherein a portion of said back extends beyond said step of said second surface.

17. An X-ray target in accordance with claim 15 wherein said step comprises a vertical portion comprising rounded corners.

18. An X-ray target in accordance with claim 15 wherein said recess is configured to maintain a selected moment of inertia of the target.

19. An X-ray target in accordance with claim 15 wherein said graphite back comprises an outer edge comprising a back step.

20. An X-ray target in accordance with claim 19 wherein said second surface step and said back step form a groove between said cap outer edge and said back outer edge.

* * * * *

UNITED STATES PATENT AND TRADEMARK OFFICE

CERTIFICATE OF CORRECTION

PATENT NO. : 6,463,125 B1
DATED : October 8, 2002
INVENTOR(S) : Minas et al.

It is certified that error appears in the above-identified patent and that said Letters Patent is hereby corrected as shown below:

Column 4,
Lines 39 and 40-41, delete "record groove 136" and substitute -- record groove 134 --.

Signed and Sealed this

Eleventh Day of March, 2003

JAMES E. ROGAN
*Director of the United States Patent and Trademark Office*